United States Patent [19]

Ogawa et al.

[11] 4,155,820

[45] May 22, 1979

[54] PURIFICATION OF AQUEOUS SODIUM CHLORIDE SOLUTION

[75] Inventors: Shinsaku Ogawa; Takashi Nishimori; Tsutomu Kanke, all of Nobeoka, Japan

[73] Assignee: Asahi Kasei Kogyo Kabushiki Kaisha, Osaka, Japan

[21] Appl. No.: 896,593

[22] Filed: Apr. 14, 1978

[30] Foreign Application Priority Data

Apr. 20, 1977 [JP] Japan ..... 52/44504

[51] Int. Cl.[2] ..... C25B 1/16; C25B 1/26

[52] U.S. Cl. ..... 204/98; 204/128; 423/140; 423/158; 423/164; 423/165; 423/166

[58] Field of Search ..... 423/158, 339, 165, 163, 423/164, 140, 166; 204/98, 128

[56] References Cited

U.S. PATENT DOCUMENTS

| | | | |
|---|---|---|---|
| 3,970,528 | 7/1976 | Zirngiebl et al. | 204/98 |
| 4,073,706 | 2/1978 | Nagy | 204/98 |
| 4,078,978 | 3/1978 | Zirngiebl | 204/98 |

*Primary Examiner*—R. L. Andrews

*Attorney, Agent, or Firm*—Birch, Stewart, Kolasch and Birch

[57] ABSTRACT

An aqueous sodium chloride solution for use in production of caustic soda in an electrolytic cell having a cation exchange membrane is purified by adding to said solution a chemical reagent for precipitation separation of impurities remove silica through co-precipitation with a slurry of the precipitates of impurities which are circulated through said solution.

9 Claims, 2 Drawing Figures

PURIFICATION OF AQUEOUS SODIUM CHLORIDE SOLUTION

Figure 1:
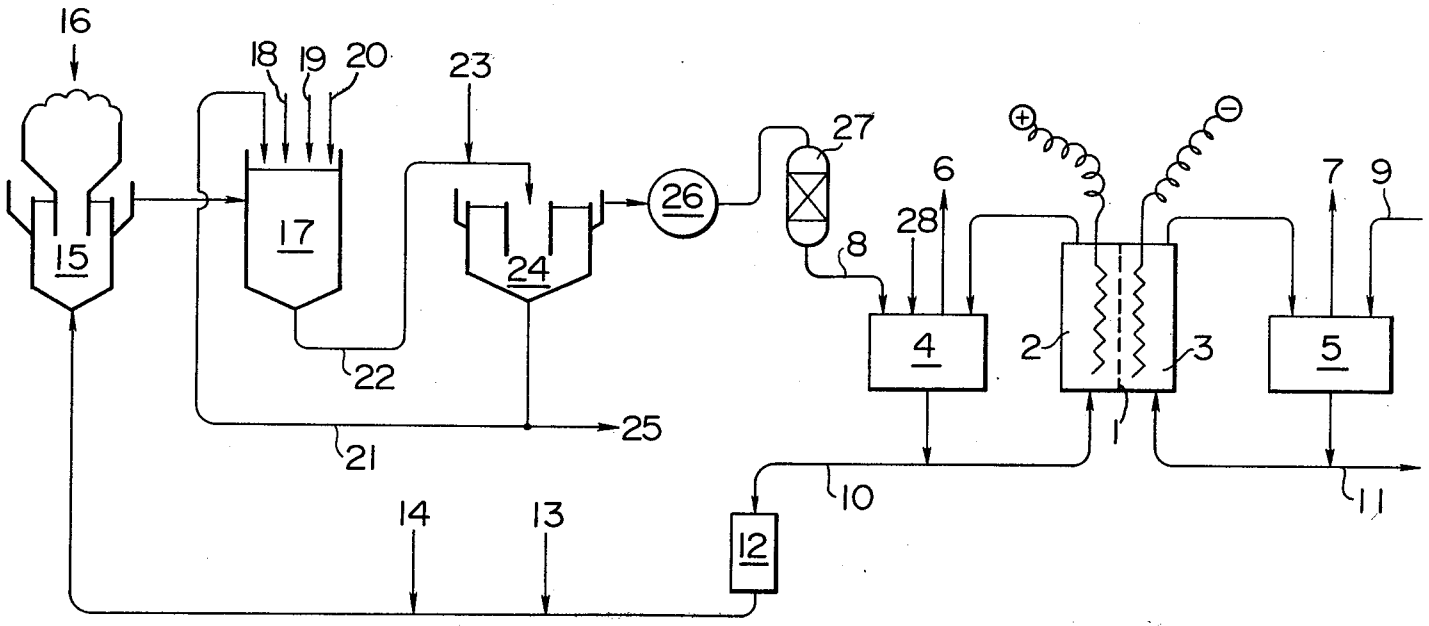

This invention relates to a process for purification of an aqueous sodium chloride solution which is fed to an electrolytic cell which employs a cation exchange membrane in order to produce caustic soda, which comprises adding a chemical reagent to said solution in order to suppress dissolution of silica in the solution in amounts as small as possible and to precipitate impurities while circulating a slurry of impurities into said solution to be simultaneously present with said reagent, thereby removing silica through co-precipitation with the impurities.

For production of caustic soda, there have been known such processes as the mercury process, diaphragm process or cation exchange membrane process. Among them, the mercury process employs mercury as the cathode which is continuously circulated and therefore there is no such problem as accumulation of silica on the cathode surface. In the diaphragm process, the diaphragm itself is asbestos which is polysilica and hence the accumulation of silica will cause no problem. Thus, in production of caustic soda by these conventional processes, it is not required to remove the silica contained in an aqueous sodium chloride solution.

On the other hand, it has now been found by the present inventors that, when caustic soda is produced in an electrolytic cell using cation exchange membranes, silica, especially polysilica, dissolved or suspended as gels or colloids in an aqueous sodium chloride solution is accumulated on the cation exchange membranes on the side of the anode to cause an increase of the electrolysis voltage.

Furthermore, it is also known that silica contained in a salty water with a concentration of salts dissolved therein of 1% or less can be removed by use of a strongly basic resin. For an aqueous solution containing 10% or more of sodium chloride, however, it is difficult to remove silica economically by use of a strongly basic resin. Similarly, although it is well known to remove silica contained in a solution with a salt concentration of 1% or less by adsorption with alumina, etc., there is known no economical removal of silica contained in a solution with a salt concentration of 10% or more by way of adsorption.

In contrast, according to the present invention, the present inventors have found that, even in an aqueous sodium chloride solution with a concentration of 10% or more, silica can be adsorbed on precipitates of magnesium hydroxide, calcium carbonate, iron hydroxide, barium sulfate, etc. at the time of precipitation thereof so as to be co-precipitated and further that the amount of silica adsorbed and co-precipitated therewith can be increased by circulation of these precipitates.

Commercially available sodium chloride generally contains sand or mud admixed therewith, thus containing silica. These impurities are dissolved or dispersed as gels or colloids at the time of dissolving the sodium chloride. In the first place, it is important to suppress the dissolution of silica in amounts as small as possible. For this purpose, it is preferred to control the pH at the time of dissolving the sodium chloride. Referring first to this point, naturally occurring silica is generally present together with the alumina. Perhaps due to the solubility of this alumina which is an ampholytic substance, silica is extremely high in solubility at pH 2 or lower or at pH 12 or higher. Further, it is preferred to first dissolve magnesium contained in sodium chloride before it is co-precipitated. Thus, it is preferred to dissolve sodium chloride at pH 9 or lower at which magnesium can be dissolved.

On the other hand, in an electrolytic cell using cation exchange membranes, an aqueous sodium chloride solution contained in the anode chamber is desired to be maintained at pH 4 or lower in order to reduce the oxygen content in chlorine gas, more preferably at pH 2 or lower in order to reduce the amount of silica accumulated on the cation exchange membrane in the electrolytic cell to a value as small as possible.

When sodium chloride is dissolved as it is in an anolyte with such a low pH, silica can easily be dissolved therein. Accordingly, it is preferred to dissolve the sodium chloride in a dilute sodium chloride solution, which is adjusted by addition of an alkali such as caustic soda at pH 4 to pH 9 after the anolyte is subjected to dechlorination. The thus prepared substantially saturated aqueous sodium chloride solution contains impurities such as cations, e.g. calcium, magnesium, iron, chromium, manganese, etc. or sulfate ions.

For separation by precipitation of these impurities, there is added in the present invention to the aqueous sodium chloride solution a chemical reagent such as sodium hydroxide, sodium carbonate, calcium hydroxide, calcium chloride, barium chloride, barium carbonate and so on. Consequently, the impurities are precipitated as magnesium hydroxide, calcium carbonate, iron hydroxide, barium sulfate, gypsum and the like. When a slurry of such precipitates of impurities is circulated so as to be present together in the aqueous sodium chloride solution and the above chemical reagent is added to said solution under such conditions, the amount of silica co-precipitated is found to be increased. The present invention is based in principle on this phenomenon.

As is well known, when a chemical reagent is added to a system under the condition wherein a slurry of precipitates of impurities is circulated, the precipitates grow to greater sizes to increase the precipitation speed as well as to improve the compressibility of the precipitates, whereby the filtration characteristics thereof can be remarkably improved. It is entirely unexpected that the amount of silica co-precipitated may be increased in a substantially saturated aqueous sodium chloride solution by such a method nor is it known that such a phenomenon is critical in connection with lowering the voltage in a process for production of caustic soda by the use of cation exchange membranes.

The chemical reagent to be used in the present invention may be added by any method known in the art, including the one step method, two step method, calcium chloride method, barium salt method, accelerator method or cyclator method, etc.

That is, in the one step method, sodium carbonate and sodium hydroxide are simultaneously added; in the two step method, sodium carbonate is first added, followed by the addition of sodium hydroxide; in the calcium chloride method, calcium chloride is added to remove sulfate ions as gypsum, followed by addition of sodium carbonate and sodium hydroxide; and in the barium salt method, barium chloride or barium carbonate together with sodium hydroxide or sodium carbonate are simultaneously added. In any of these methods, there is provided a thickener and the slurry of the precipitates of impurities herein precipitated may be circulated to the reactor in which the chemical reagent is added in accordance with the present invention.

Further, for the practice of the present invention, as is seen in the case of an accelerator or cyclator, the reaction chamber to which the chemical reagent is added and the precipitation tank may be made integrally in one body wherein the chemical reagent may be added under the condition of increased slurry concentration as the result of residence and concentration of the precipitates in the reaction chamber.

In the following, the slurry concentration of the precipitates of impurities present is described. In general, commercially available sodium chloride contains impurities in amounts of 0.2 to 0.02% of calcium, 0.2 to 0.01% of magnesium, 0.6 to 0.1% of sulfate ions and 0.5 to 0.01% of silica, etc. The sodium chloride concentration in the anode chamber by the ion-exchange membrane process is from about 100 g/liter to about 200 g/liter; to this dilute solution is further dissolved sodium chloride which is to be supplied to the anolyte system in a concentration of about 300 g/liter to 315 g/liter.

Thus, the composition of typical components contained in the aqueous sodium chloride solution to be purified in the present invention generally falls within the following ranges:

Ca: 300 mg/l—30 mg/l
Mg: 300 mg/l—15 mg/l
$SO_4$: 20 g/l—1 g/l
Silica: 1 g/l—20 mg/l
NaCl: 290 g/l—320 g/l Accordingly, impurities are formed as precipitates from the solution after dissolving the sodium chloride usually in amounts of about 0.3% to 0.03%. However, it is preferred to circulate a slurry into the reaction vessel in which the chemical reagent is added to precipitate impurities so that the precipitates of impurities may be present therein in amounts of 3 to 0.3%. As the amount of slurry to be circulated is increased, the amount of silica adsorbed is increased. But, if the slurry concentration is too high, there ensues a problem such as clogging.

The pH at which silica is co-precipitated should preferably be maintained at pH 8 to 11, since silica will not be co-precipitated or dissolved again even when co-precipitated at pH 4 or lower or at pH 12 or higher.

After a chemical reagent is added to perform reaction and form precipitates, followed by co-precipitation of silica, the precipitates are separated in a thickener. At this time, it is preferred to add a high molecular weight agglomerating agent. For example, an alkali starch is added in an amount of 10 to 20 ppm or a synthetic organic high molecular weight compound such as a polysodium acrylate type or acrylamide type compound in an amount of 0.5 to 2 ppm. By circulation of a slurry, the sizes of the precipitates become greater, and consequently the precipitation speed is increased and the filtrating and compression characteristics are improved. Therefore, the amount of the precipitates in the overflow obtained with the use of a thickener at an elevation speed of 1 to 2 m/hour may be made to comprise from 20 to 5 ppm.

Accordingly, the resultant overflow can be directly subjected a leaf filter or a filter employing a filtration aid such as activated charcoal to effect filtration. In this filtrate, calcium ions are dissolved in an amount of 20 ppm or less, magnesium ions in an amount of 1 ppm or less and other heavy metal ions such as iron. It is preferred to reduce such ions as calcium, magnesium or heavy metal ions like iron to 0.1 ppm or less by ion-exchange with a chelate resin before the solution is used for an electrolytic cell using cation exchange membranes. With a higher content of these ions, they may be accumulated on the cation exchange membranes to increase the voltage thereof.

Referring now to the relation between silica and the cation exchange membranes, it is well known that silica occurring in nature will have remarkable changes in solubility or polymerization degree, stability of colloid or gel, or isoelectric point, etc. depending on the kind or amount of heavy metal ions copolymerized, the conditions for formation, pH of the solution, etc. It is difficult to carry out correct quantitative determination of polysilica dissolved or dispersed in an aqueous sodium chloride solution. But soluble silica can be quantitatively determined by the Silicomolybdic Acid Blue method. Accordingly, by using the result of quantitative analysis of soluble silica in equilibrium with polysilica as a barometer, the step for purification of the aqueous sodium chloride solution can controlled. Accordingly, when control is made by the amount of soluble silica, the silica is gradually accumulated up to 20 to 30 ppm in a purified aqueous sodium chloride solution of soluble silica content without use of the present process. This is because there is no place for discharging silica in closed systems comprising an anode system, sodium chloride dissolving system and aqueous sodium chloride solution purification system other than discharging the silica together with precipitates of impurities.

Under such a condition, polysilica becomes accumulated and adhered in an amount of about 1 $g/m^2$ on the anode side of the cation exchange membrane to cause an increase in the electrolysis voltage of about 0.2 to 0.3 volt by electrolysis at a current density of 50 $A/dm^2$. In order to avoid such a condition, it is preferred to apply the process of the present invention to reduce the amount of soluble silica in a purified aqueous sodium chloride solution to 4 ppm or less.

The cation exchange membrane to be used in the present invention may preferably comprise a fluorine resin as a mother matrix having cation exchange groups of the type such as perfluoro sulfonic acid type, perfluoro carboxylic acid type or perfluoro sulfonamide type. The electrolytic cell to be used in the present invention may preferably be that in which the cathode chamber is separated by a cation exchange membrane from an anode chamber, an aqueous sodium chloride solution is supplied to the anode chamber to generate chlorine gas and caustic soda and hydrogen gas are generated in the cathode chamber.

Figure 2:
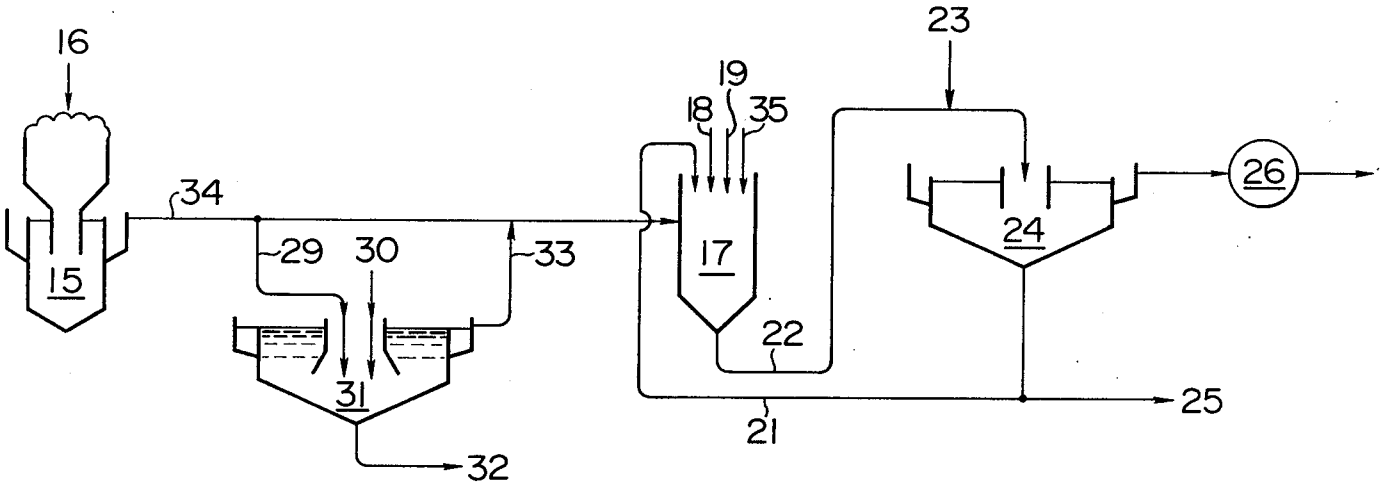

The present invention may be better understood with reference to the accompanying drawings, in which:

FIG. 1 shows a flow sheet of an electrolysis process in which the process for purification of an aqueous sodium chloride solution of the present invention is applied; and FIG. 2 is a flow sheet with a partial modification of FIG. 1 in which the present invention is applied using a purification process with calcium chloride.

The following Examples are given merely as illustrative of the present invention and are not to be considered as limiting.

EXAMPLE 1

In the flow sheet shown in FIG. 1, 1 is a cation exchange membrane, 2 an anode chamber, 3 a cathode chamber, 4 an anolyte tank, 5 a catholyte tank, 6 a chlorine gas line, 7 a hydrogen gas line, 8 a purified aqueous sodium chloride solution line containing sodium chloride with a concentration of 310 g/liter, and 9 a pure water line for controlling the caustic soda concentration in the cathode chamber. Elements 4 and 2 are under circulation with a part of the dilute aqueous sodium chloride solution being discharged through line 10.

Element 5 and 3 are also under circulation, and the caustic soda formed is discharged through line 11.

Element 12 is a dechlorination tower and 13 is a caustic soda line from which caustic soda is added so that the pH in the sodium chloride dissolving tower 15 may be from 4 to 9.

Element 14 is a line for water from which there is supplemented water to be consumed in the system such as water migrating from the anode chamber to the cathode chamber through a cation exchange membrane or water accompanied with chlorine gas. Element 15 is a sodium chloride dissolving tower.

Element 16 is solid sodium chloride, 17 a reaction vessel, 18 caustic soda, 19 sodium carbonate, 20 barium chloride or barium carbonate, 21 a line for circulating precipitates of the impurities, 22 a feed line to thickener, 23 a line for addition of agglomerating agent, 24 thickener, 25 the precipitates of impurities to be discharged out of the system, 26 a filter for filtration of overflow from thickener, 27 a cation exchange tower filled with chelate resin and 28 a feed line of hydrochloric acid for maintaining the pH at a constant value in the anode chamber.

In this flow, an aqueous sodium chloride solution purified so as to contain 310 g/liter of sodium chloride, 20 ppb of calcium ion, 10 ppb of magnesium ion and 1.5 g/liter of sulfate ion is added from line 8 and 35% of hydrochloric acid from line 28 into anolyte tank 4 to maintain the concentration of the aqueous sodium chloride solution in the anolyte tank at 180 g/liter and at pH 2.

The aqueous sodium chloride solution with the same composition as mentioned above is discharged through line 10, adjusted at pH 4 to 9 by line 13 and conveyed to the sodium chloride dissolving tower.

The sodium chloride added from 16 has an average composition as follows:

| | |
|---|---|
| Calcium | about 0.05% |
| Magnesium | about 0.04% |
| $SO_4$ | about 0.15% |
| Silica, etc. | about 0.02% |
| NaCl | about 96.5% |

The above sodium chloride is dissolved in water and allowed to react in the reaction vessel with addition of caustic soda, sodium carbonate and barium carbonate so that the components dissolved in the filtrate from filter 26 may be as follows:

| | |
|---|---|
| Calcium | about 10 ppm |
| Magnesium | about 0.3 ppm |
| $SO_4$ | about 1.5 g/liter |

Accordingly, the following precipitates are formed per liter of saturated aqueous sodium chloride solution from the outlet of the reaction vessel:

| | |
|---|---|
| $CaCO_3$ | about 0.200 g/liter |
| $Mg(OH)_2$ | about 0.155 g/liter |
| $BaSO_4$ | about 0.583 g/liter |
| Others | about 0.032 g/liter |
| Total | about 0.97 g/liter |

On the other hand, when a slurry containing about 80 g/liter of precipitates is circulated from the underflow of the thickener to the reaction vessel to vary the concentrations of the precipitates at the outlet of the reaction vessel, the concentrations of soluble silica or other heavy metals in the filtrate at the outlet of the filter 26 are measured to give the results as shown in Table 1.

In the above experiment, the reaction vessel is maintained at 60° C. with a residence time of about 10 minutes and pH of about 10.2.

From the line 23, 0.7 ppm of an acrylamide type high molecular agglomerating agent is added.

As the result of operation of the thickener at an elevation speed of about 1 m/hour, the amount of precipitates in the overflow of the thickener is about 10 ppm.

Table 1

| Amount of slurry circulated* | | 0 | 10 | 20 | 30 |
|---|---|---|---|---|---|
| | pH | 10.2 | 10.2 | 10.2 | 10.2 |
| $SiO_2$ | (mg/liter) | 19 | 11 | 6 | 4 |
| V | " | 0.067 | 0.066 | 0.051 | 0.044 |
| Cr | " | 0.108 | 0.013 | 0.0075 | 0.008 |
| Fe | " | 0.08 | 0.03 | 0.08 | 0.03 |

*Times as much as the amount of impurities to be precipitated.

As apparently seen from Table 1, soluble silica and heavy metals are co-precipitated with the increase in amount of the slurry circulated to reduce the concentrations thereof.

Thus, maintaining the soluble silica concentration at about 4 ppm and further subjecting the resultant aqueous sodium chloride solution to purification in a cation exchange tower 27 filled with chelate resins to a calcium ion content of 20 ppb and magnesium ion content of 10 ppb, there is obtained a purified aqueous sodium cloride solution. By adding this solution into the anolyte tank, electrolysis is carried out. When electrolysis is conducted using a cation exchange membrane of the perfluorosulfonic acid type at a current density of 50 $A/dm^2$ at 90° C., the electrolysis voltage is found to be 4.2 V. On the other hand, when no slurry is circulated from line 21, the soluble silica concentration is increased to about 19 ppm to be equilibrated thereat, whereby the electrolysis voltage is found to be about 4.5 V.

EXAMPLE 2

In this Example, purification of an aqueous sodium chloride solution is carried out by the calcium chloride method.

As shown in FIG. 2, a part of the outlet line 34 from the sodium chloride dissolving tower is branched through line 29 to accelerator 31, wherein calcium chloride is added from line 30, and gypsum is discharged from 32.

The overflow is returned through line 33 again to line 34 and then added to the reaction vessel 17, wherein caustic soda or calcium hydroxide 18, sodium carbonate 19, ferric chloride 35 and a slurry of precipitates 21 are added.

All of the other conditions are the same as the flow in FIG. 1, the operational conditions being also substantially the same as in Example 1 (In FIG. 2, the same numerals as those in FIG. 1 have the same meanings.).

The sodium chloride added from 16 has an average composition as follows:

| | |
|---|---|
| Calcium | about 0.06% |
| Magnesium | about 0.02% |
| $SO_4$ | about 0.16% |
| Silica, etc. | about 0.03% |
| NaCl | about 97.4% |

The above sodium chloride is dissolved in water and allowed to react in the reaction vessel with addition of caustic soda, sodium carbonate and ferric chloride so that the components dissolved in the filtrate from the filter 26 may be as follows:

| | |
|---|---|
| Calcium | about 10 ppm |
| Magnesium | about 0.3 ppm |
| $SO_4$ | about 10 to 15 g/liter |

In the above experiment, the operation is performed by batchwise addition of calcium chloride.

As the result, the precipitates formed per liter of saturated aqueous sodium chloride solution from the outlet of the reaction vessel are as follows:

| | |
|---|---|
| $CaSO_4$ | about 0.363 g/liter |
| $CaCO_3$ | about 0.220 g/liter |
| $Mg(OH)_2$ | about 0.077 g/liter |
| $Fe(OH)_2$ | about 0.010 g/liter |

On the other hand, in the reaction chamber of the accelerator 31, precipitates of gypsum are suspended at a concentration of about 100 g/liter and the underflow 21 from the thickener 24 is circulated so as to maintain the slurry concentration of the precipitates in the outlet line from the reaction vessel at about 6 g/liter.

Thus, it is possible to maintain the concentration of soluble silica in the outlet liquid from the filter 26 at about 4 ppm.

Further, the aqueous sodium chloride solution is purified in cation exchange tower 27 filled with chelate resins to a calcium ion content of about 20 ppb and magnesium ion content of about 10 ppb before it is added to the anolyte tank for electrolysis.

When electrolysis is carried out using a cation exchange membrane of the perfluorosulfonic acid type at a current density of 50 A/dm$^2$, at 90° C., the electrolysis voltage is found to be 4.2 V.

In contrast, when no slurry is circulated from line 21, the concentration of soluble silica is increased to about 19 ppm to be equilibrated thereat, whereby the electrolysis voltage is found to be about 4.4 V.

What we claim is:

1. A process for the purification of an aqueous sodium chloride solution containing dissolved silica which is fed to an electrolytic cell having a cation exchange membrane for use in the production of caustic soda, which comprises adding a chemical reagent to said aqueous solution for the precipitation-separation of impurities therefrom and also circulating a slurry of precipitates of impurities into the solution, thereby co-precipitating silica with the impurities.

2. A process as in claim 1, wherein a slurry comprising precipitates of impurities and a thickener are circulated into said solution.

3. A process as in claim 2, wherein said thickener is a high molecular weight agglomerating agent.

4. A process as in claim 3, wherein said high molecular weight agglomerating agent is an alkali starch, or a polysodium acrylate or acrylamide high molecular weight compound.

5. A process as in claim 1 or claim 2, wherein the precipitates of impurities are selected from the group consisting of magnesium hydroxide, calcium carbonate, iron hydroxide, barium sulfate and gypsum.

6. A process as in claim 1 or claim 2, wherein the chemical reagent employed for the precipitation-separation of impurities is selected from the group consisting of caustic soda, sodium carbonate, calcium hydroxide, calcium chloride, barium chloride, barium carbonate and ferric chloride.

7. A process as in claim 1 or claim 2, wherein the pH at the time of co-precipitation of the silica is maintained at 8 to 11.

8. A process as in claim 1 or claim 2, wherein the sodium chloride is dissolved in a dilute aqueous sodium chloride solution discharged from an anode chamber of an electrolytic cell and maintained at pH 4 to 9 with the addition of an alkali.

9. A process as in claim 1, wherein the slurry of precipitates of impurities being circulated is maintained at a concentration of at least 0.3 wt. %.

* * * * *